US005533373A

United States Patent [19]

Plester

[11] Patent Number: 5,533,373

[45] Date of Patent: Jul. 9, 1996

[54] METHOD AND APPARATUS FOR MAKING SHAPED CANS

[75] Inventor: George Plester, Brussels, Belgium

[73] Assignee: The Coca-Cola Company, Atlanta, Ga.

[21] Appl. No.: 309,688

[22] Filed: Sep. 21, 1994

[51] Int. Cl.[6] ..... B21D 51/26

[52] U.S. Cl. ..... 72/84; 72/111; 72/379.4

[58] Field of Search ..... 72/57, 85, 94, 72/102, 111, 379.4, 465, 466, 105, 106, 84

[56] References Cited

U.S. PATENT DOCUMENTS

| | | |
|---|---|---|
| 2,317,869 | 4/1943 | Walton . |
| 2,783,727 | 3/1957 | Hoffmann . |
| 2,878,767 | 3/1959 | Paulton . |
| 3,698,337 | 10/1972 | Brawner et al. . |
| 3,757,555 | 9/1973 | Blutt et al. . |
| 3,808,868 | 5/1974 | Wolfe . |
| 3,812,696 | 5/1974 | Kneusel et al. . |
| 4,389,147 | 6/1983 | Van Alsburg . |
| 4,510,780 | 4/1985 | Cadwell . |
| 4,953,376 | 9/1990 | Merlone . |

FOREIGN PATENT DOCUMENTS

| | | | |
|---|---|---|---|
| 1034574 | 7/1958 | Germany | 72/85 |
| B1171837 | 6/1964 | Germany . | |

*Primary Examiner*—Lowell A. Larson
*Attorney, Agent, or Firm*—Birch, Stewart, Kolasch & Birch

[57] ABSTRACT

A method and apparatus for shaping cans entails placing an inflatable flexible-walled mandrel inside a drawn can body, inflating the mandrel, rotating the can body and the inflated mandrel, applying a forming tool, such as a rubber-surfaced roller, to the exterior surface of the can body to deflect the sidewall inwardly, deflating the mandrel and withdrawing it from the shaped can body. The flexible walls of the mandrel may have corrugations longitudinally thereof for selective shaping of the can body. The mandrel may also include separate sections along its longitudinal axis having different expansion capabilities for each section. The mandrel may also include movable end plates at distal ends of the flexible walls and an incompressible fluid therebetween wherein the mandrel is inflated by compressing the plates.

11 Claims, 3 Drawing Sheets

GRIP

SHAPE

INSERT

WITHDRAW & EJECT

METHOD AND APPARATUS FOR MAKING SHAPED CANS

BACKGROUND

The present invention relates to a method and apparatus for shaping cans, such as metal cans used for beverages. More specifically, the present invention relates to a method and apparatus for shaping cans utilizing an inflatable mandrel within the can body in conjunction with various external shaping tools.

Currently, most large-scale mass-produced cans used for food and beverage are straight-wall. Shaped cans can be an important marketing instrument, if means of producing these inexpensively can be established, because they create product identity.

Technology exists for shaping cans, but each available solution has some/all of the following disadvantages:

A relatively high cost because of an inability to decorate the straight-wall can before shaping (because of use of external chucks), and/or complex/high-maintenance means of applying pressure to the can side-wall, and/or capital-intensive means of picking-up/centering the can, and/or the necessity to make can-shaping an additional, separate process.

A reliance on outward-shaping (i.e. expanding the metal in such a way as to increase the straight-wall can diameter in the areas shaped). Particularly in the case of two-piece drawn cans, the scope of this outward-expansion is limited, because current technology already draws the metal to its ultimate degree in order to reduce cost. When the can walls are expanded further for the purpose of shaping, the metal cracks or deforms.

A limitation in shaping scope. This limitation includes inability to shape the entire straight-wall can surface (typically, because the can is held in an external chuck and shaping behind the chuck is not possible), and/or the inability to produce non-radial shapes, and/or the inability to produce outward-expanded as well as inward-compressed shapes.

A limitation to three-piece cans and not usable for two-piece cans.

A limitation in choice of can material (aluminum or steel), typically because expansion requires very high pressures with steel, or because the use of external chucks is unsuitable for thin-walled aluminum cans.

SUMMARY

Accordingly, it is the object of this invention to provide a method of shaping mass-produced cans, which addresses the problems with current technology by:

Reducing capital and operating costs by gripping can internally (thus avoiding risk of damage to can decoration, or to the can itself, due to external chucks. This in turn, enables pre-decoration of straight-wall cans before shaping); using a simple internally-gripping tool, which in itself provides both the can-picking-up and the centering function; employing a shaping method which can also be applied to the normally-necessary can-necking-in and flanging, so that the shaping process becomes part of an existing production step.

Avoiding limitations in can-shape by enabling inward-shaping, as well as outward-shaping, on any part of the side-wall and making non-radial shaping also possible.

Enabling shaping of both 2-piece and 3-piece cans.

Avoiding limitations in can material.

The objects of the invention are fulfilled by providing a method of shaping a can comprising the steps of:

a) providing a flexible-walled inflatable mandrel;

b) inserting the mandrel into a can body and picking up the can body, while it is being guided in a single stream (or multiple streams) by conventional conveyor guide rails, where necessary with the indexing help of a star-wheel, or similar device;

c) inflating the mandrel until the flexible walls thereof firmly grip inside surfaces of walls of the can body;

d) applying a forming tool to any selected surface portion of the entire can body to deflect the can body sidewalls in the selected portion inwardly into the mandrel; and or pressing selected portions of the can body outwardly against a forming tool by expanding the mandrel;

e) deflating the mandrel; and f) withdrawing the mandrel from the shaped can body.

This is achieved by a mandrel, which is hollow, constructed of reinforced rubber or other flexible material, and shaped to contact the entire inner side-wall of the can after expansion. In the preferred embodiment, the cavity of the mandrel is filled with a suitable non-compressible fluid, and the mandrel is designed so that its end-walls can be pulled toward one-another, thus causing the side-walls of the mandrel to expand due to the pressure exerted by the displaced fluid in the mandrel's cavity. Alternatively, the mandrel can be inflated by means of ducting compressed air (or other fluid) into the cavity of the mandrel. When the side-walls of the mandrel are expanded outwards, they apply pressure evenly on the inside of the entire side-wall of the can.

When the side-walls of the mandrel are contracted, they are sufficiently distant from the inner surface of the can side-wall so that the mandrel can be easily inserted into the can, and later withdrawn after shaping. The mandrel can therefore be used to pick up, to center and to set-down the can, and provides a backing for shaping tools placed on the outside of the can. It permits all forms of shaping, depending on the external tools used, including the normal necking-in and flanging operations in the can-opening.

The mandrel rotates to enable inward radial shaping. The mandrel's rotation can be stopped and the mandrel inserted into an external mold to enable non-radial, or outward-radial shaping, where this mold is constructed in 2 halves and these 2 halves are closed to confine the outside of the can. Alternatively, simple, conventional tools can be used to produce longitudinal ridges, etc. The rubber walls of the mandrel are reinforced with steel or nylon thread, using conventional means common to the motor-tire industry, so as to provide strength for the forces needed to expand metal. The mandrel is constructed in a form which permits its diameter to expand, in spite of non-expandable reinforcement by convoluting the rubber wall of the mandrel along its longitudinal axis.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will be more readily understood from the detailed description given hereinbelow, and the accompanying drawings, which are given by way of illustration only and thus are not limiting to the present invention, and wherein.

DETAILED DESCRIPTION

Figures 1, 2:
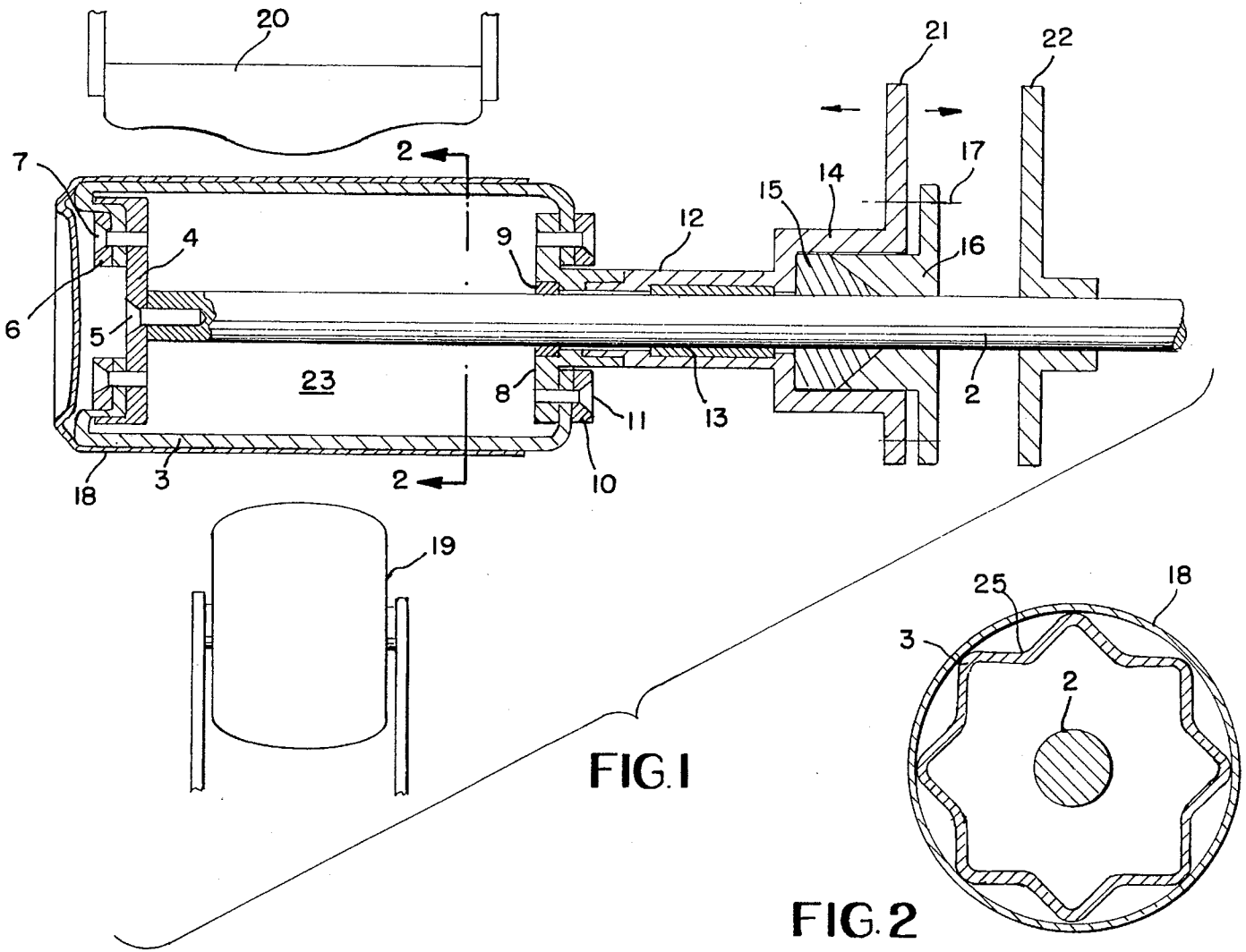
FIG. 1, shows the mandrel and the particular embodiment, which involves a non-compressible fluid in the cavity formed by the outer walls of the mandrel, and which permits the ends of the mandrel to be drawn together so that the internally-trapped fluid forces the mandrel's radial walls outwardly and enables them to press against the side-walls of a can in which the mandrel is inserted.
FIG. 2, shows a section of the mandrel demonstrating how the radial walls can be made to expand outwardly in spite of non-expandable reinforcement.

FIG. 1, shows the mandrel 1, which comprises of a central-rod 2, and a reinforced rubber sleeve 3. The central-rod 2 connects to a flange-ring 4, to which it is fixed by counter-sunk screws 5. The end of the rubber-sleeve 3 is fixed to the flange-ring 4 by means of a fixing-ring 6 and countersunk ring screws 7. At the other end of the rubber-sleeve 3, the central-rod 2 passes through a sliding flange-ring 8, in which there is a bearing ring 9. The bearing-ring 9 in turn contacts the central-rod 2 and permits the central-rod 2 to move freely through the sliding flange-ring 8. This enables the distance between the flange-ring 4 and sliding-flange-ring 8 to be changed. The rubber-sleeve 3 is fixed to the sliding flange-ring 8 by means of a fixing-ring 10 and countersunk ring screws 11. The sliding-flange-ring 8 is screwed into a bearing-housing 12, in which is located a bearing 13 and to which is connected a seal-housing 14. A seal 15 is compressed in the seal-housing 14 by a press-ring 16 and ring bolts 17.

A can 18 slips over the mandrel 1. The mandrel 1 can 18 be made to rotate and the can may then be shaped using rotating radial tools 19 of appropriate shape and dimensions for radial shaping. Non-rotating longitudinal tools 20—or externally placed cavity molds (not shown)—of appropriate shape and dimensions can be used for indenting longitudinal shapes, or expanded radial shapes, whilst mandrel 1 is not rotating. The means of rotation of the mandrel 1 is applied conventionally to the central-rod 2 and is not shown.

The seal-housing 14 has an actuating-finger 21 which runs in a rail (not shown), or other similar device, in a conventional rotating machine (also not shown), so that it is moved in the directions shown (i.e. back and forth), thus changing the distance between flange-ring 4 and sliding-flange-ring 8. This compresses/decompresses the fluid 23 in the cavity of the rubber-sleeve 3. The cam-follower 22 runs in a rail (not shown), and enables the mandrel 1 to be moved back/forth during the operational cycle. This is also part of a conventional rotating machine, and this machine comprises a plurality of mandrels 1.

FIG. 2, shows a detail of the mandrel 1 and particularly shows the section of the rubber-sleeve 3 before expansion. The rubber-sleeve 3 has indentations 25 of predetermined depth, so that on full expansion these either grip the inside of the can 18 firmly or expand further to press out the walls of the can 18 at the appropriate section.

Figure 3:
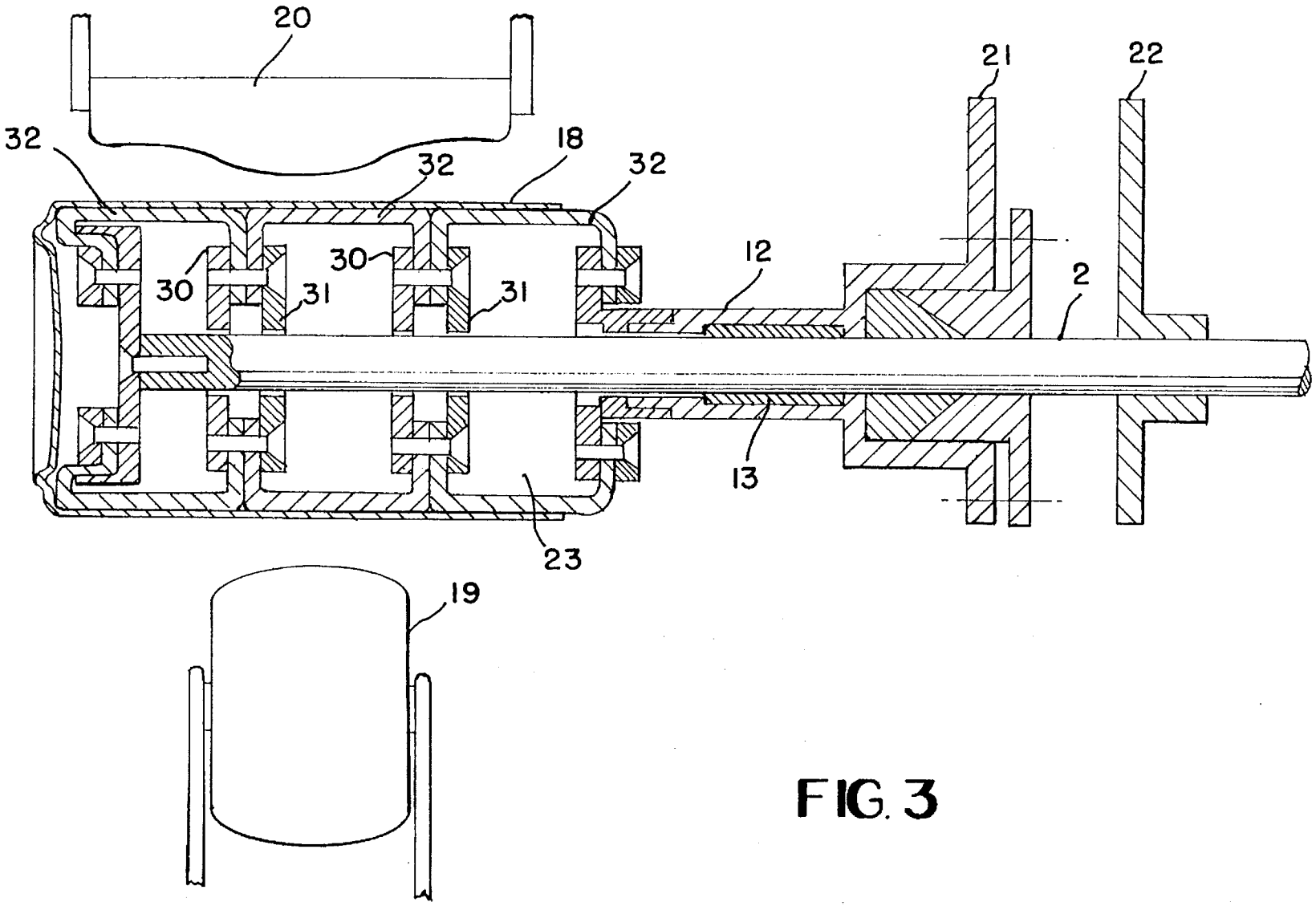
FIG. 3, shows the mandrel with a multiplicity of sections, enabling each section to perform differently with respect to outward expansion.
Figure 4B:
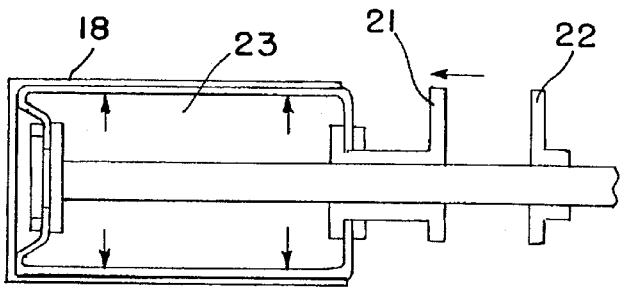
FIG. 4A–4D, show a sequence of shaping operations, where the mandrel is first inserted in the can, then made to expand and grip the inside of the can wall. This is followed by shaping operation(s) by means of external tools, or by using a conventional, split shaping-mold, which partially (or completely) encases the outer walls of the can (mold not shown). Finally the mandrel is withdrawn by causing its sidewalls to contract. During the insertion and grip operations, the mandrel is used to pick-up and center the can, and the mandrel is also used to set down the can, during the mandrel-withdrawal-stage, after the shaping operation is complete.
Figure 4C:
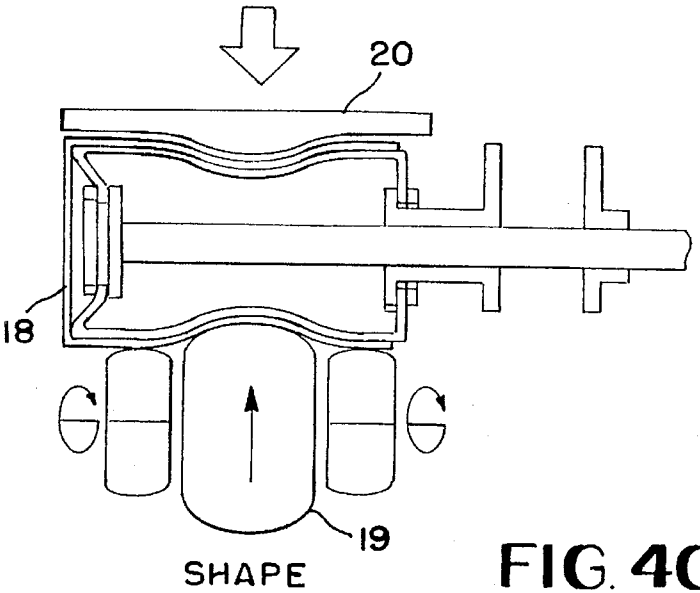
Figure 4A:
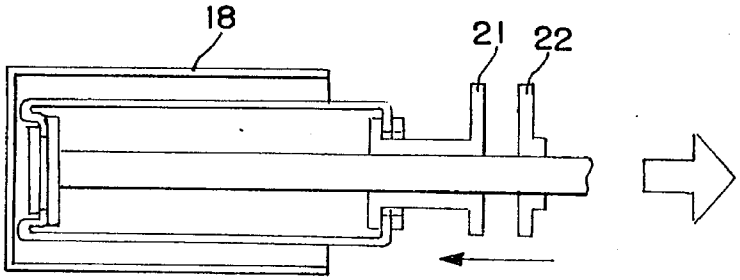
Figure 4D:
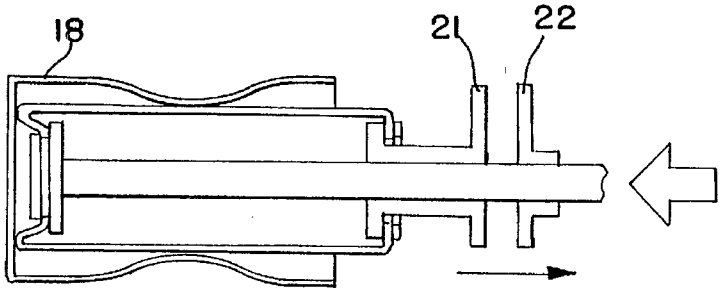

FIG. 3, shows a multi-section rubber-sleeve. Intermediate flange-ring(s) 30, and intermediate keep-ring(s) 31, enable the rubber-sleeve 3 to be separated into 2 or more sections 32. Each section 32 may have its own individual depth of indentation 25 and all sections 32 are compressed together by compressing action on fluid 23 already described. This enables each section 32 either to expand and grip the inside of the can 18, or to expand further so that the side-wall of the can 18 is expanded outwardly, as desired.

FIG. 4A–4D, show the sequence of operation of the mandrel 1 in a rotary machine (not shown) wherein position A it is inserted into the can 18, due to the motion of the cam-follower 22 in the direction shown by the action of a rail (not-shown). In position B, the actuating-finger 21 moves in the direction shown, thus shortening the length of the mandrel 1, and compressing fluid 23. This forces the walls of the rubber-sleeve 3 outwardly, gripping the inside walls of the can 18 and/or expanding these walls, outwardly and radially. In position C, the mandrel 1 rotates, enabling radial tools 19 to shape the can radially, and/or remains still (non-rotating), enabling longitudinal tools 20 to shape the can longitudinally, and/or remains still (non-rotating) enabling outward shaping into a cavity mold (not shown). In position D, the actuating-finger 21 moves back in the direction shown, increasing the length of the mandrel 1, so that it is now able to withdraw past the shaping protrusions made in the can 18. The mandrel 1 is then withdrawn by means of the can-follower 22 which is moved in the direction shown. The cycle A to D can now be repeated.

There is a multiplicity of mandrels 1 and these are conventionally mounted in a rotating machine (not shown) so that the mandrels pass through operations A to D. The actuating-fingers 21 and cam-followers 22 run in rails (not shown) within this machine, and the shape of these rails determines their motion at the appropriate stages as indicated herewith. The machine, the rails and other actuating details, are conventional technology, and are not described in further detail.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of shaping a can comprising the steps of:

a) providing a flexible-walled inflatable mandrel;

b) inserting the mandrel into a can body;

c) inflating the mandrel until the flexible walls thereof firmly grip inside surfaces of walls of the can body;

d) removing any external support of the can body so that the mandrel becomes the sole means of support thereof;

e) applying a forming tool to any selected surface portion of the entire can body to deflect the can body sidewalls in the selected portion inwardly into the mandrel thereby shaping the can body;

f) deflating the mandrel; and g) withdrawing the mandrel from the shaped can body.

2. A method of shaping a can comprising the steps of:

a) providing a flexible-walled inflatable mandrel;

b) inserting the mandrel into a can body;

c) inflating the mandrel until the flexible walls thereof firmly grip inside surfaces of the walls of the can body;

d) applying forming tools to the selected surface portions of the can body to deflect the can body sidewalls in the selected portion inwardly into the mandrel thereby shaping the can body, said step of applying forming tools including the substeps of, 1) rotating the can body about its longitudinal axis while pressing a forming tool radially thereof to form selected circumferential shapes in the can body, 2) holding the can body so that it does not rotate, and 3) moving a forming tool longitudinally thereof to form selected longitudinal shapes;

e) deflating the mandrel; and f) withdrawing the mandrel from the shaped can body.

3. Apparatus for shaping a can comprising:

a) a flexible-walled inflatable mandrel;

b) means for inserting the mandrel into a can body while supporting the can body;

c) means for inflating the mandrel until the flexible walls thereof firmly grip inside surfaces of the walls of the can body;

d) means for removing any external support of the can body so that the mandrel becomes the sole means of support thereof;

e) means for applying a forming tool to any selected surface portion of the entire can body to deflate the can body sidewalls in the selected portion inwardly into the mandrel thereby shaping the can body;

f) means for deflating the mandrel; and g) means for withdrawing the mandrel from the shaped can body.

4. Apparatus for shaping a can comprising:

a) a flexible-walled inflatable mandrel;

b) means for inserting the mandrel into a can body while supporting the can body;

c) means for inflating the mandrel until the flexible walls whereof firmly grip inside surfaces of the walls of the can body;

d) means applying forming tools to selected surface portions of the can body to deflate the can body sidewalls in selected portions inwardly into the mandrel thereby shaping the can body, said means for applying forming tools including, 1) means for rotating the can body about its longitudinal axis while pressing a forming tool radially thereof to form selected circumferential shapes in the can body, 2) means for holding the can body so that it does not rotate, and 3) means for moving a forming tool longitudinally thereof to form selected longitudinal shapes;

e) means for deflating the mandrel, and f) means for withdrawing the mandrel from the shaped can body.

5. Apparatus for shaping a can comprising:

a) a flexible-walled inflatable mandrel, said mandrel including a plurality of separate sections longitudinally thereof, each section having different radial expansion capabilities, b) means for inserting the mandrel into a can body while supporting the can body;

c) means for inflating the mandrel until the flexible walls thereof firmly grip inside surfaces of the walls of the can body;

d) means for applying a forming tool to any selected surface portion of the entire can body to deflate the can body sidewalls in the selected portion inwardly into the mandrel thereby shaping the can body;

e) means for deflating the mandrel; and f) means for withdrawing the mandrel from the shaped can body.

6. The apparatus of claim 5 wherein at least one of said sections has spaced longitudinal corrugations in the flexible walls thereof defining peaks and depressions, said peaks engaging the inner walls of the can body as the mandrel is inflated before the depressions engage the inner walls, said depressions having predetermined depths so that when expanded by further inflation of the mandrel the degree of expansion of the depressions is controllable to regulate the gripping force thereof against the inner surface of the can body and the radius of expansion of the depressions.

7. The apparatus of claim 6 wherein each of said sections has said spaced longitudinal corrugations.

8. The apparatus of claims 3, 4, 5, or 6 wherein said mandrel includes two relatively movable plates at the distal ends thereof and non-compressible fluid contained between said plates and the flexible walls of the mandrel, and there is further means for compressing said plates to inflate said mandrel.

9. The apparatus of claims 3, 4, or 6 wherein said mandrel includes a plurality of separate sections longitudinally thereof, each section having different radial expansion capabilities.

10. The apparatus of claims 2, 4 or 5 wherein said mandrel includes spaced longitudinal corrugations in the flexible walls thereof defining peaks and depressions, said peaks engaging the inner walls of the can body as the mandrel is inflated before the depressions engage the inner walls, said depressions having predetermined depths so that when expanded by further inflation of the mandrel the degree of expansion of the depressions is controllable to regulate the gripping force thereof against the inner surface of the can body and the radius of expansion of the depressions.

11. Apparatus for shaping a can comprising:

a) a flexible-walled inflatable mandrel, said mandrel having spaced longitudinal corrugations in the flexible walls thereof defining peaks and depressions, said peaks engaging the inner walls of the can body as the mandrel is inflated before the depressions engage the inner walls, said depressions having predetermined depths so that when expanded by further inflation of the mandrel the degree of expansion of the depressions is controllable to control the gripping force thereof against the inner surface of the can body and the radius of expansion of the depressions;

b) means for inserting the mandrel into a can body while supporting the can body;

c) means for inflating the mandrel until the flexible walls thereof firmly grip inside surfaces of the walls of the can body;

d) means for applying a forming tool to any selected surface portion of the entire can body to deflate the can body sidewalls in the selected portion inwardly into the mandrel thereby shaping the can body;

e) means for deflating the mandrel; and f) means for withdrawing the mandrel from the shaped can body.

* * * * *